United States Patent [19]

Castagnoli

[11] 4,310,276

[45] Jan. 12, 1982

[54] MACHINE FOR SORTING OBJECTS OF VARIOUS DESTINATIONS PARTICULARLY SUITABLE FOR BULKY POSTAL CORRESPONDENCE

[75] Inventor: Guiseppe Castagnoli, Arenzano, Italy

[73] Assignee: Elettronica San Giorgio ELSAG S.p.A., Genova-Sestri, Italy

[21] Appl. No.: 129,462

[22] Filed: Mar. 11, 1980

[30] Foreign Application Priority Data

Apr. 19, 1979 [IT] Italy ..... 22015 A/79

[51] Int. Cl.[3] ..... B07C 5/00

[52] U.S. Cl. ..... 414/134; 209/900; 209/912; 209/914; 209/933; 209/942; 209/706; 209/698; 198/528

[58] Field of Search ..... 209/DIG. 900, DIG. 912, 209/DIG. 914, DIG. 922, DIG. 933, DIG. 942, 706, 698; 414/134, 135, 136; 198/436, 528

[56] References Cited

U.S. PATENT DOCUMENTS

| | | | |
|---|---|---|---|
| 2,689,657 | 9/1954 | Lens | 414/134 |
| 2,863,574 | 12/1958 | Henig | 414/134 |
| 4,008,813 | 2/1977 | Leersnijer | 209/900 |

*Primary Examiner*—Allen N. Knowles

*Attorney, Agent, or Firm*—Cushman, Darby & Cushman

[57] ABSTRACT

A machine for sorting objects of various destinations, particularly for bulky postal correspondence. A guide defines a path passing through at least one loading station and at least one sorting station. At least one succession of compartments for containing individual objects is moved along said guide. Each compartment is in the form of a narrow pigeon hole, which has its surface of maximum size perpendicular to the direction of movement of the compartment and is provided with an operable base wall.

10 Claims, 10 Drawing Figures

MACHINE FOR SORTING OBJECTS OF VARIOUS DESTINATIONS PARTICULARLY SUITABLE FOR BULKY POSTAL CORRESPONDENCE

This invention relates to a machine for sorting objects of various destinations, particularly but not exclusively suitable for bulky postal correspondence.

There is a need, which is particularly felt in the field of bulky postal correspondence (printed matter, bulky letters, packages), for machines which are able to sort objects of various kinds and shapes, mostly flat, towards a number of exits equal to the number of final destinations of the objects, in a single operational stage. Mechanised sorting in two stages would in fact be uneconomical, mainly because the object destination would have to be coded by the operators at each sorting stage, i.e. twice, as there is no provision for printing any code on the objects.

The operational characteristics which are considered most important in machines of this kind are the hourly capacity (number of objects sorted per hour) which the machine can attain, the dimensional and physical characteristics of the objects which can be handled, the number of sorting directions, the overall size and modularity.

Sorting machines of the following types are either used or under test at the moment:

(a) Sorting machines which convey the objects on trays. Sorting is carried out be rotating the tray at the appropriate sorting exit.

(b) Sorting machines with a conveying system in the form of sections. The sections are disposed so as to form a continuous band which is segmented by baffles which define the sections. Sorting is carried out with the aid of pushers or switch blades, which deviate the objects towards the respective destination exits.

(c) Sorters in the form of belts and rollers. The belts convey the objects longitudinally, and a system of rotating rollers emerges from the belt system to deviate the individual objects towards one or other of two directions perpendicular to the belts.

(d) Container sorting machine. This is an experimental machine in which each object is inserted into its own container, in the form of a grip, which is fed from a coding station together with various other containers along a highly branched path constituted by monorails at several levels, with switching points and converging sections. This path branches by way of a series of successive switching points to generate a number of branches equal to the final destinations, where a consistent number of containers with their objects is accumulated. These branches then successively gradually converge to a single exit which leads to a stacker. Groups of containers waiting in the sorting branches are fed in turn to the stacker, where the objects are separated from the containers and collected in a plastic box which is then used for their despatch, while the containers themselves return to the coding stations.

Stacking machines of type (a) and type (b) in which sorting is carried out by pushers have certain unfavourable characteristics, which negatively affect the capacity and overall size of the machine, namely:

The trajectory followed as the objects drop into the sorting exits is "dispersed" because of the indetermination of the position of the object on the tray or in the section, and because of the influence of the dimensions of the object on the moment in which the object begins to fall. In addition, the object is positioned in such a manner that its maximum overall dimension lies in the feed direction of the plates or sections. To overcome this and prevent the "falling dispersion" from causing mistakes (falling into the wrong exit), the aperture of the sorting exits must be widened by means of deflectors or hoppers, and thus proportionally increase the longitudinal bulk of the sorting machine or reduce the conveying speed (the falling dispersion is directly proportional to the speed).

The sorting capacity, which is equal to the ratio of the conveying speed to the distance between successive conveyors, is low and is around 5000 objects per hour per conveying line, because of the fact that the aforesaid disposition of the object in the container makes the distance between successive containers large.

Only one or two exits can be disposed in one cross-section of the machine, and the longitudinal bulk of the machine therefore increases very rapidly as the number of exits increases. The number of exits which can be provided in practice is therefore limited, and is much less than the number of final divisions normally carried out in centres such as postal sorting stations.

Sorting machines of type (b) comprising switch blades do not have drawbacks due to falling dispersion, but the capacity, which is about 9600 objects per hour, is still limited by the fact that the objects are conveyed along the direction of their maximum overall dimension. In addition, the use of these sorting machines is limited to flat objects, and in postal sorting stations this limitation imposes a severe manual requirement in separating flat objects from packages. Finally, by providing only two exits in the cross-section of the machine, its overall size increases very rapidly with the number of exits, and the maximum practical number, which is about 100, is still far from the requirements of postal handling.

Sorting machines of type (c) are also limited in their capacity to less than 5000 objects per hour, and the sorting exits are very long dimensionally (about 600 mm). They are also unsuitable for objects which are not flat, such as packages.

The experimental sorting machine of type (d) has a much higher capacity, and can comprise a large number of exits in a small space. However, it is of considerable mechanical complexity, comprising rails at several levels, switching points and converging sections which, in the case of a fault, can lead to severe down-grading of the machine. In addition, the use of this sorting machine is limited to flat objects.

None of the present known machines has therefore fully satisfactory characteristics, particularly with regard to its use in the postal correspondence field.

The object of the present invention is to provide a sorting machine, particularly but not exclusively for postal use, which has a high sorting capacity, is able to handle objects of different dimensional and physical characteristics, has a large number of exits within a very small overall machine size, and can be easily adapted to the variable characteristics and dimensions of the environments in which it is to be installed.

According to the invention, this object is attained by a sorting machine comprising a closed-circuit guide of varying configuration passing through at least one loading station including at least one loading position which is fed in succession with the objects to be sorted, and at least one sorting station including a plurality of collection containers for objects of different destination, and a succession of compartments for containing individual objects, which can be moved along said guide in order to convey the objects from said loading station to said sorting station, said compartments being in the form of narrow pigeon holes having their surface of maximum size perpendicular to the direction of movement, said pigeon holes being open upperly for loading the objects and being provided with base walls which can be opened on command in order to discharge the objects into said collection containers.

This machine structure according to the invention has many merits, which make it clearly preferable to known machines, and which can be summarised as follows:

(a) By conveying the objects in mobile compartments transversely to their surface of maximum size, a high linear density is obtained for the containing compartments (number of compartments per linear meter of path) and consequently for the objects themselves.

As the machine capacity is proportional to said linear density for a given feed speed of the containing compartments, it is possible to attain very high capacities even for modest feed speeds. Other conditions being equal, the capacity can be doubled, tripled, etc., by associating with the guide not just one but two or more successions of compartments which move in parallel.

In this respect, it has been calculated that by using a single continuous succession of 50 mm compartments interspersed periodically with 200 mm compartments (for the purpose explained hereinafter), the capacity which can be attained with a movement speed of 0.5 m/sec. is 24,000 objects per hour, and thus reaches 48,000 objects per hour if two adjacent successions are used.

(b) The machine is able to handle flat objects of various thicknesses, such as letters, tickets, commercial invoices, printed matter, newspapers, magazines, reviews, books, catalogues etc. By preferably interspersing compartments of greater width at a suitable frequency, it is possible to also simultaneously handle some traffic constituted by objects of greater size, such as samples of goods, packages, bunches of letters and printed matter etc.

(c) It is possible to provide even a very large number of exits (collection containers) within a very small overall size, for the following reasons:

the dispersion of the objects falling into the sorting exits is small, as all the objects fall from the same height and present their section of minimum size, this latter characteristic also enabling the feed speed of the containing compartments to be kept low. Consequently, the aperture (and thus the overall size) of the sorting exits, which in every known machine, and in the machine according to the invention, constitute the maximum part of the overall machine size, can be reduced to a minimum;

the main dimension of the various machine parts (sorting exits, loading positions) extends along the path of the containing compartments, and as this path is defined by a simple guide, it can be varied with considerable flexibility so as to utilise the available space to greatest advantage. The longitudinal dimension of the machine, which is its greatest dimension, can thus be kept very low even for a large number of exits.

(d) The characteristics of the machine are such as to give it complete modularity. In this respect, the number of loading positions can vary freely from one to some tens, and the number of sorting exits can vary from a few to some hundreds, as the upper limit is not limited by any technical factor. The maximum capacity can be varied practically continuously, by varying the number of containing compartments in circulation, up to some tens of thousands of objects per hour. The path of the containing compartments can be varied practically at will by constructing the guide in the form of straight and curved portions which can be fitted together at will, and possibly including rising and falling ramps, switch blades, branches etc., so as to be able to adapt the configuration of the machine to any requirement of the building which houses it.

These and further characteristics of the present invention will be more apparent from the detailed description given hereinafter of one possible embodiment, illustrated by way of non-limiting example on the accompanying drawings, in which.

Figure 1:
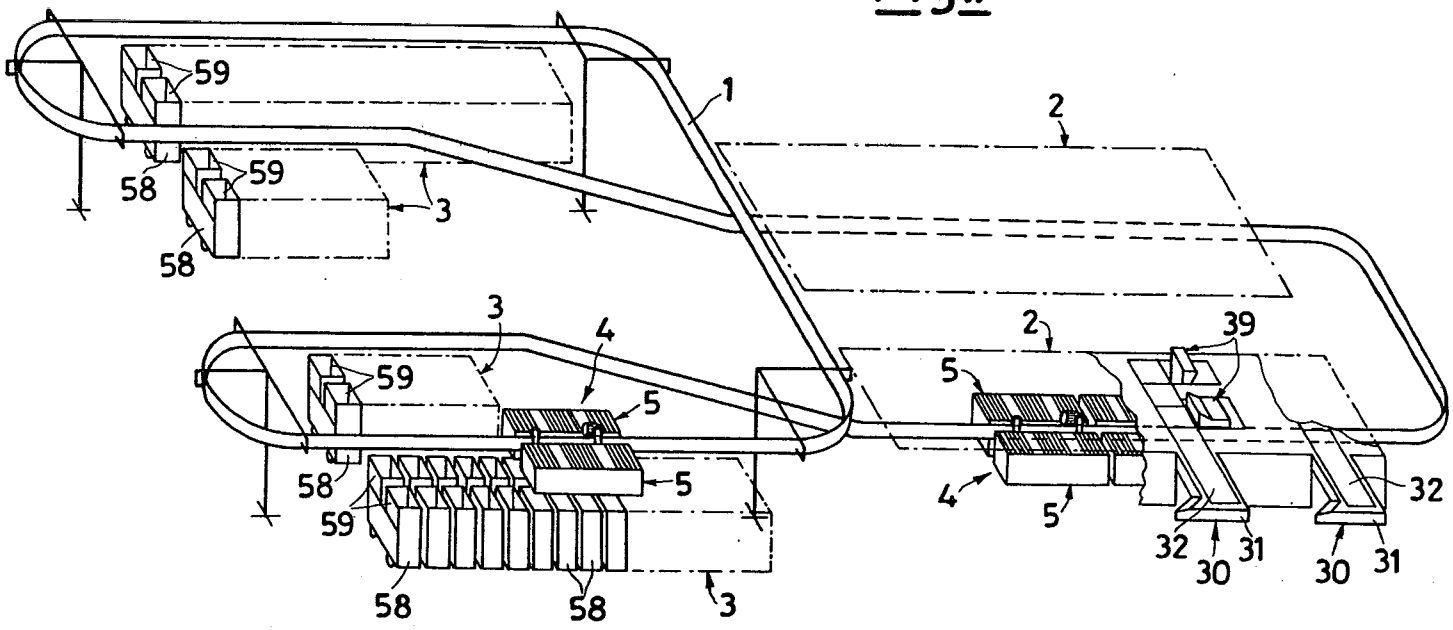
FIG. 1 is a diagrammatic perspective view of the general configuration of the machine.
Figure 2:
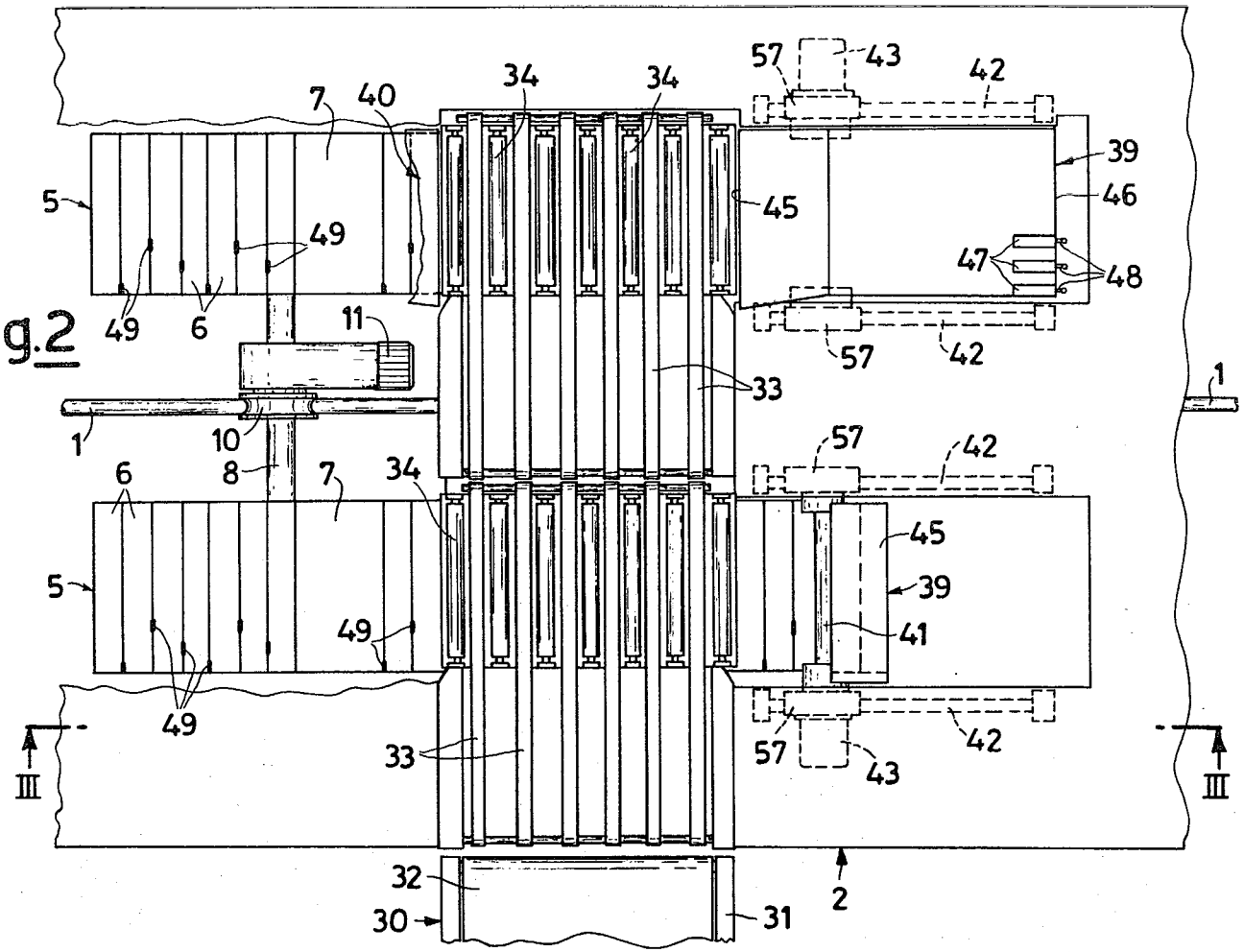
FIG. 2 is a plan view from above of an object loading position included in said machine.

The sorting machine shown on the drawings comprises a guide in the form of a rail 1, which is formed from a number of portions joined together, and extends as a closed circuit of the form shown in FIG. 1. Two loading stations 2 and four sorting stations 3 are positioned along said guide, which supports mobile carriages 4, each constituted by two packs 5 of compartments for housing the objects to be sorted. Each of the two packs 5 is constituted by a succession of narrow containing compartments 6 in the form of an upperly open pigeon hole, which are periodically interspersed with a compartment 7 of greater width (FIGS. 1, 2 and 8). Said packs 5 are connected rigidly together by two pairs of connection cross members 8 (FIGS. 2 and 6–8), which are connected by brackets 9 to two pulleys 10, one of which comprises a motor 11, these pulleys running on the rail 1. Each bracket 9 also carries a pair of rollers 12, which slidably engage with the opposite sides of the rail 1 (FIG. 7).

Figure 10:
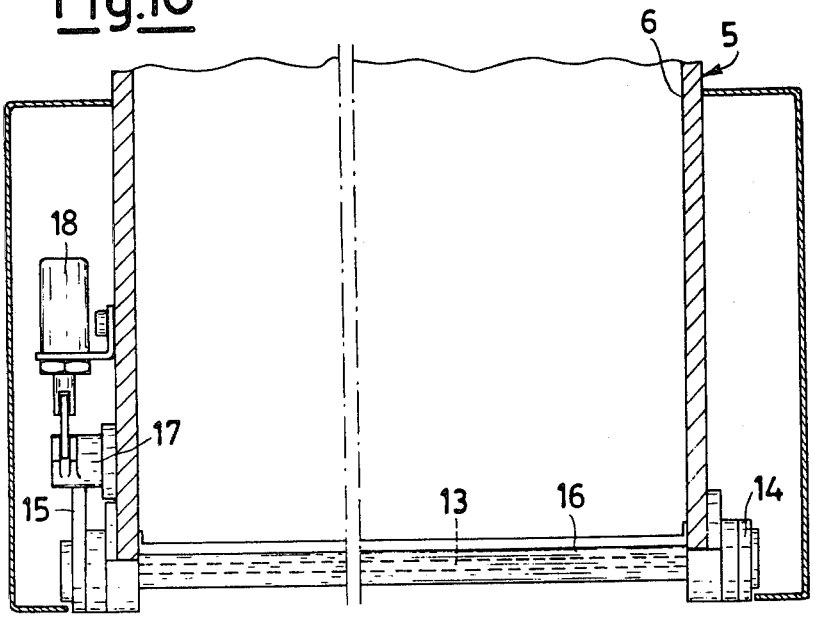
FIG. 10 is a section through the bottom part of said compartments on the line X—X of FIG. 8.
Figure 8:
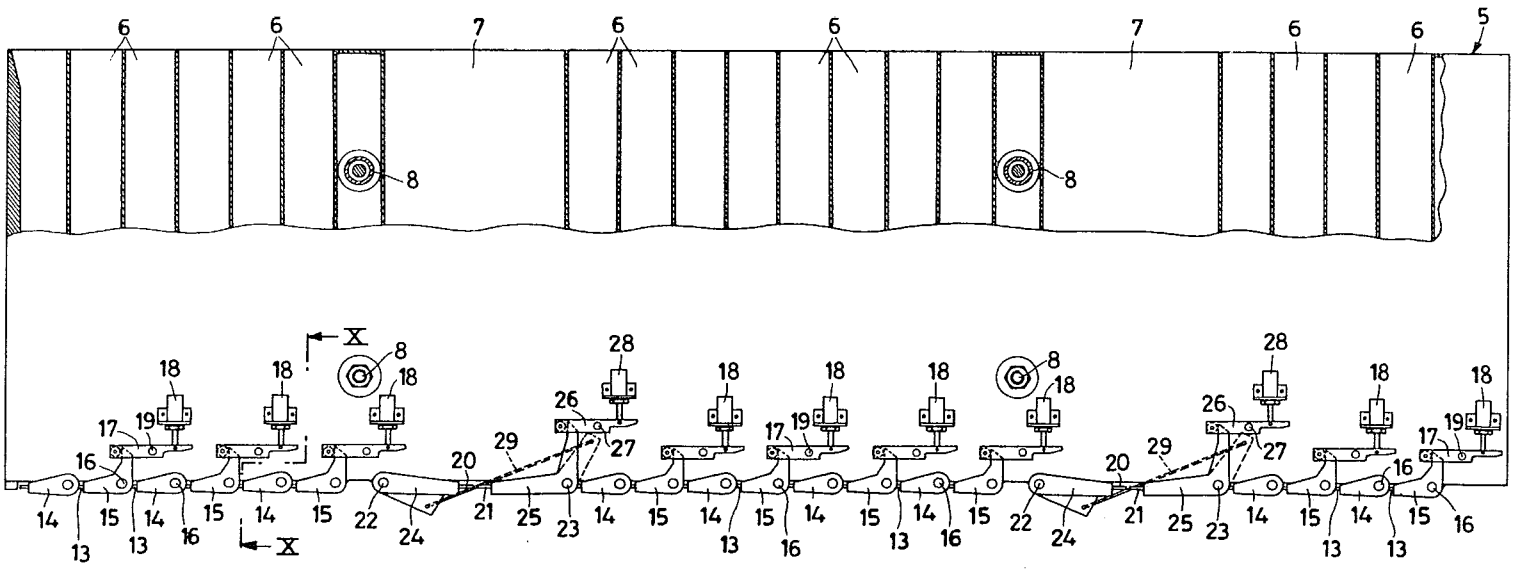
FIG. 8 is an enlarged side view showing the details of a group of containing compartments such as that shown in FIG. 6.
Figure 9:
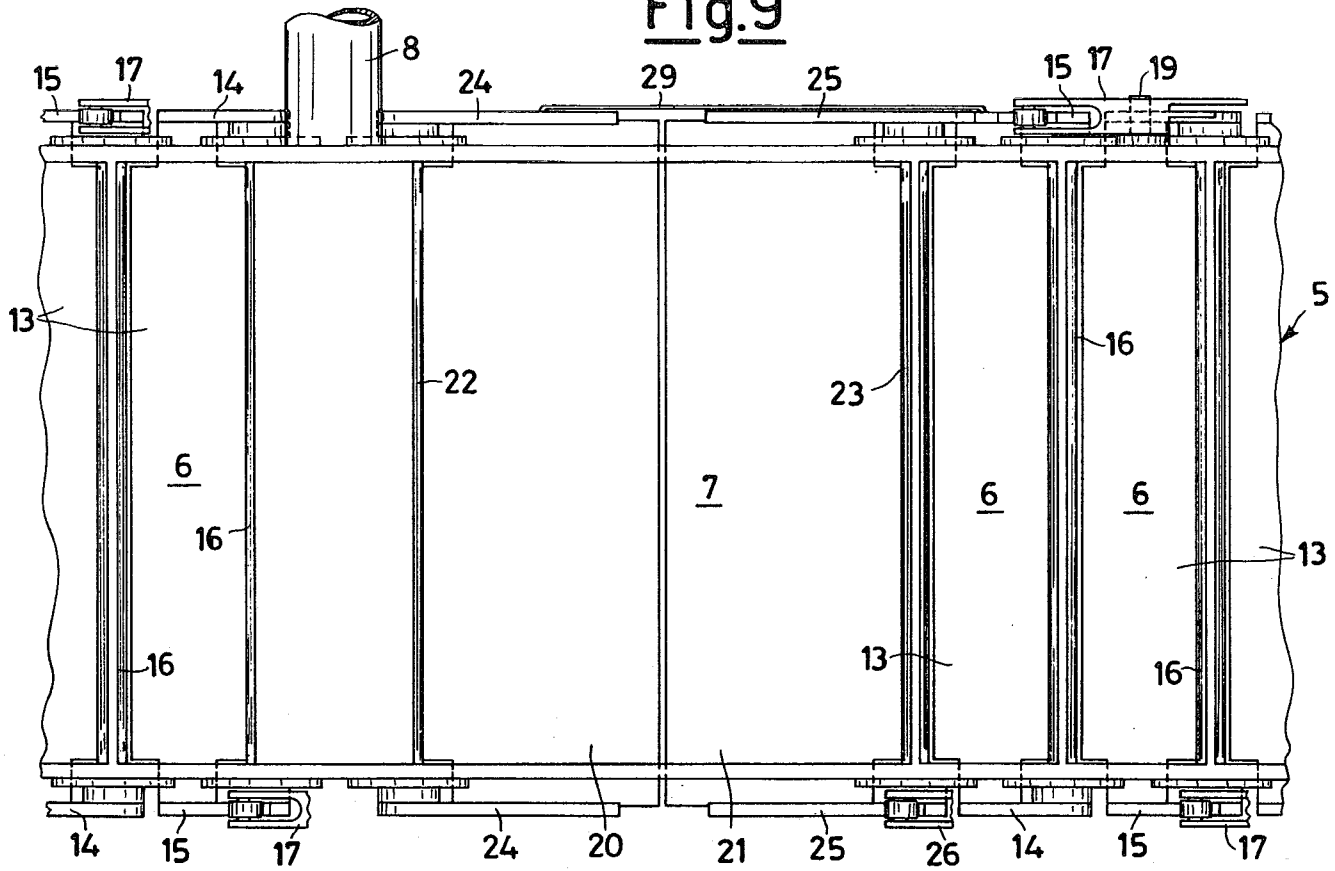
FIG. 9 is a plan view of some of said containing compartments seen from above.

As shown in FIGS. 8, 9 and 10, each narrow compartment 6 is closed lowerly by an openable base wall 13, which is connected at its two side ends to a pair of arms 14 and 15 pivoted at 16, of which the first is straight and the second is in the form of a right angle. Said arms 14 and 15 alternate in position between one compartment 6 and the next, in the sense that one compartment 6 has the arm 14 on the left and the arm 15 on the right arm when observing FIG. 10, while the next compartment 6 has the arm 14 on the right and the arm 15 on the left. Each arm 15 is associated with a lever 17, which maintains it in the closed position shown in FIG. 8, towards which it is yieldably urged by a spring, not shown, until a respective actuator 18 is operated. When this happens, the lever 17 rotates about the pivot 19, so disengaging the arm 15 and allowing the relative compartment 6 to open under the weight of the object contained therein, as is explained in detail hereinafter.

The wide compartments 7 are closed lowerly by a pair of openable base walls 20 and 21, rotatable about respective axes 22 and 23, and connected at their ends to respective pairs of rotatable arms 24 and 25, of which the first are straight and the second are in the form of a right angle (FIG. 8). One of the two arms 25 is maintained in the closed position by a lever 26 pivoted at 27 and provided with a control actuator 28, and is yieldably urged towards this closed position by a spring, not shown, while on the other side of the compartment 7, the other arm 25 is linked to the corresponding arm 24 by a rod 29 hinged at its ends (FIG. 8).

Figure 3:
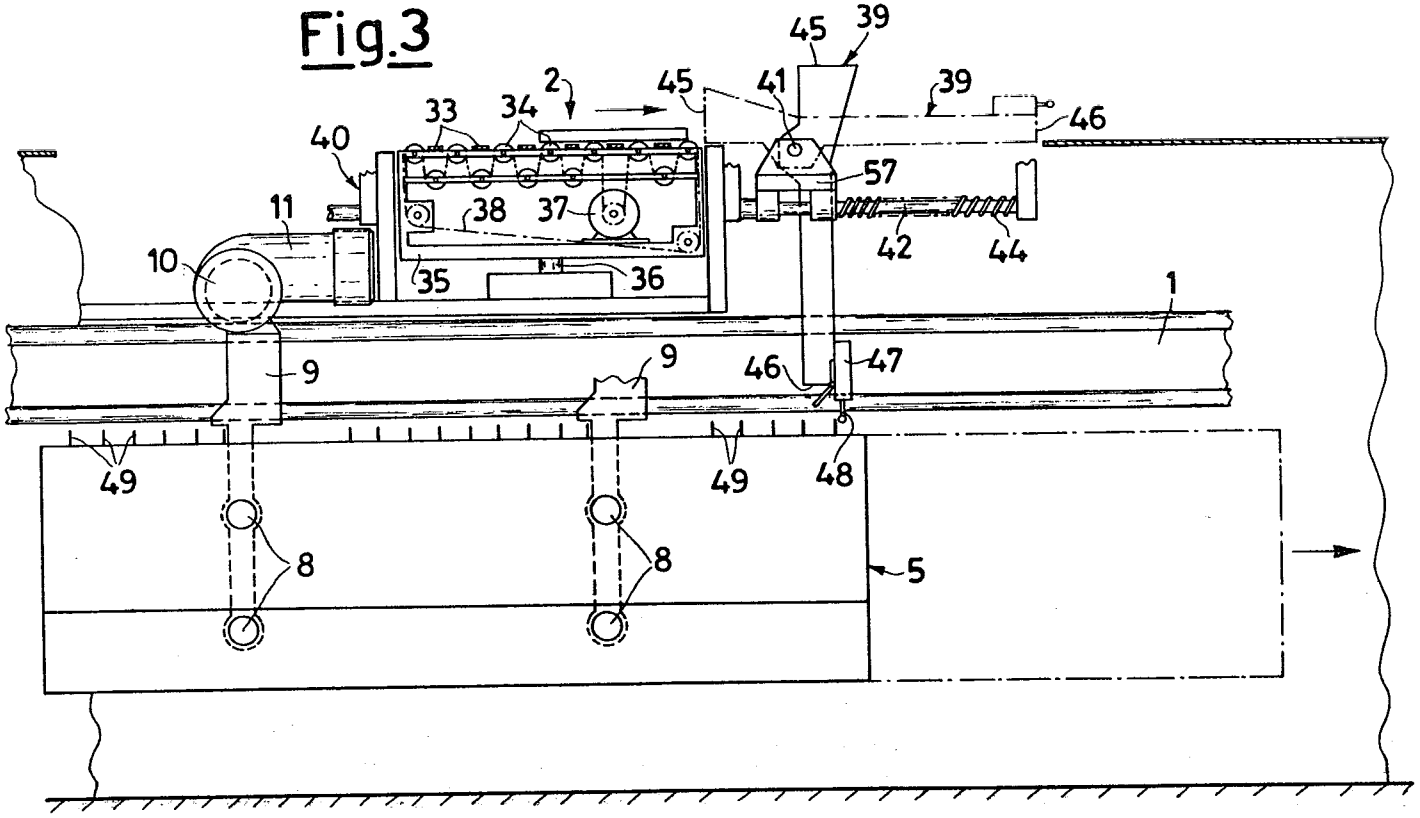
FIG. 3 is a section through said loading position on the line III—III of FIG. 2.
Figure 4:
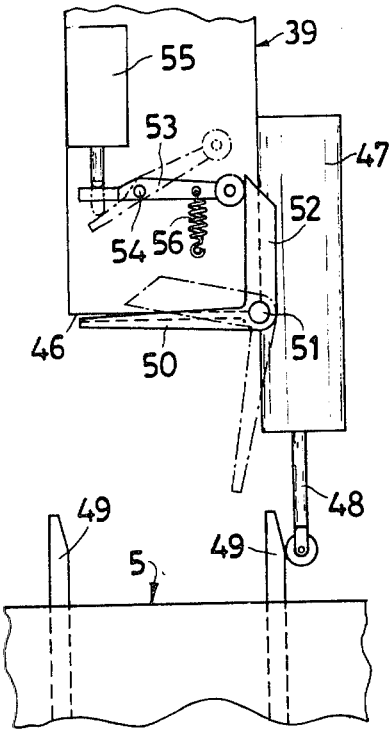
FIG. 4 is an enlarged front view of the exit end of a chute for conveying the objects into the relative containing compartments, and which is included in the loading position of FIGS. 2 and 3.
Figure 5:
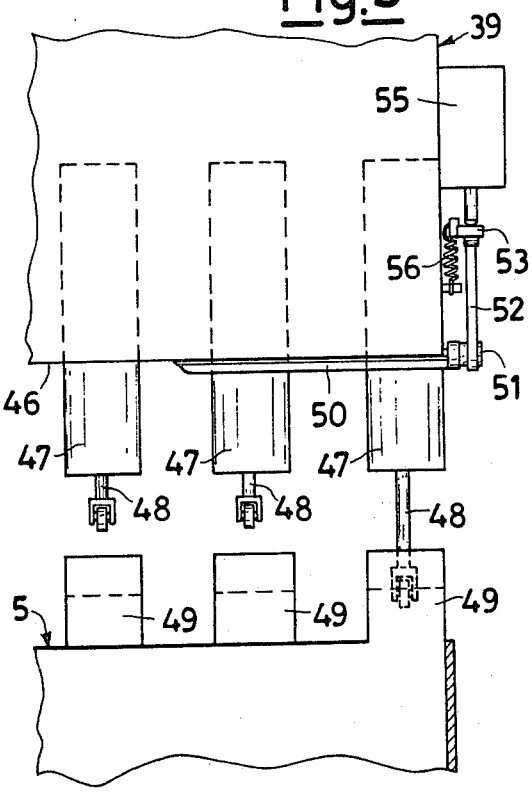
FIG. 5 shows the same detail viewed from the left of FIG. 4.

The carriages 4 are loaded with the objects to be sorted (not more than one object for each compartment 6 or 7) in one of the two loading stations 2, by using one of the loading positions 30 included in each of said stations. One of these loading positions is shown in detail in FIGS. 2 to 5, and comprises a loading and coding bench 31, where an operator codes the individual objects, and communicates the sorting data to a suitable control unit. A conveyor belt 32 is disposed on this bench for feeding the objects one at a time to a plurality of parallel belts 33 which are disposed above the feed path of the closer of the two packs 5 of each carriage 4 and are interspersed with rollers 34 carried by a frame 35 which can be raised by a hydraulic or pneumatic cylinder 36 (FIG. 3). Both the belts 33 and rollers 34 are motor driven, the former by means not shown, and the latter by a reversible motor 37 by way of a chain or belt 38 (FIG. 3). As shown in FIG. 2, a second plurality of parallel belts 33 is disposed to follow the first above the feed path of the further of the two packs 5 of each carriage 4, and likewise interspersed with rollers 34 carried by a frame which can be raised in the manner of the frame 35. This second group of belts 33 and rollers 34 is also suitably motor driven. According to whether the rollers 34 of the first group are kept lowered or are raised relative to the corresponding belts 33, the objects fed on to the feed belt 32 are either transferred to the belts 33 of the second group, or are deviated by said rollers 34 towards the right or towards the left (relative to FIG. 2) depending upon the direction of rotation given to the rollers by the motor 37. The objects transferred to the belts 33 of the second group are likewise deviated towards the right or towards the left depending on the direction of rotation given to the rollers 34 of the second group.

The objects are received by two chutes 39 which are disposed one on each side of each group of rollers 34, and are designed to receive objects of standard flat shape for insertion into the narrow compartments 6 of the two packs of compartments 5 of the carriages 4, and by two chutes 40 disposed one on each side of each group of rollers 34 and designed to receive larger objects for insertion into the wide compartments 7 of said packs of compartments. The two types of chutes 39 and 40 differ only by the width of their exit mouths, which obviously correspond to the different widths of the compartments 6 and 7, because of which their illustration and description is limited here to those of a single type, namely the chutes 39 for the narrow compartments 6.

As shown in FIGS. 2 and 3, each chute 39 is rotatably supported at 41 by a support 57 slidable along a pair of guide bars 42 against springs 44. A motor 43, also supported by the support 57, rotates the chute 39 from the position shown by dashed and dotted lines in FIG. 3 to the position shown by continuous lines in the same figure, and vice versa. In the first position, the chute has an inlet mouth 45 facing the rollers 34 in order to receive the object intended for it, while in the second position the chute has an outlet mouth 46 facing the upper loading mouth of an underlying compartment 6, to which said chute can be momentarily coupled by operating one or other of three actuators 47, which pushes out an arm 48 arranged to engage with the corresponding projection of three cyclically offset projections 49 on the walls which bound the compartments 6 (FIGS. 2 to 5). The outlet mouth 46 is normally closed by a door 50 rotatable about a pin 51 (FIG. 4) and yieldably urged into the closed position by a spring, not shown. Said door 50 is rigidly connected to a rigid arm 52, which is normally maintained in the position corresponding to closure of the door 50 by a lever 53 pivoted at 54 and controllable by means of an actuator 55 against a return spring 56.

The result is that an object fed by the belt 32 on to one of the two roller beds 34 and deviated from there towards a chute 39 if intended for a narrow compartment 6 (but with the same procedure taking place in the case of an object intended for a wide compartment 7 and thus deviated towards a chute 40), enters the chute 39 and immediately falls towards the outlet mouth 46 by the effect of the immediate rotation of the chute into the vertical position shown by continuous lines in FIG. 3, by the motor 43. As a result of this rotation, the arm 48 which has been thrust outwards by the selected actuator 47 engages with a corresponding projection 49 of the carriage 4, and is thus obliged to momentarily follow the movement of this latter, by utilising the facility for movement given to the support 57 by the guide bars 42. While the chute 39 follows the movement of the carriage 4, the control unit causes the actuator 55 to operate and rotate the lever 53 into the position shown by dashed and dotted lines in FIG. 4, so disengaging the arm 52 and allowing the object contained in the chute to open the door 50 and fall into the compartment 6 intended for it. Because of the synchronous movement of the chute 39 and carriage 4, this falling motion takes place reliably and perfectly, without any possibility of error between one compartment and another and without the object becoming rejected by the carriage 4. The door 50 then recloses automatically, the actuator 47 is returned to its rest position on releasing the chute from the carriage, and the chute is finally returned to a horizontal position by the motor 43.

Figure 6:
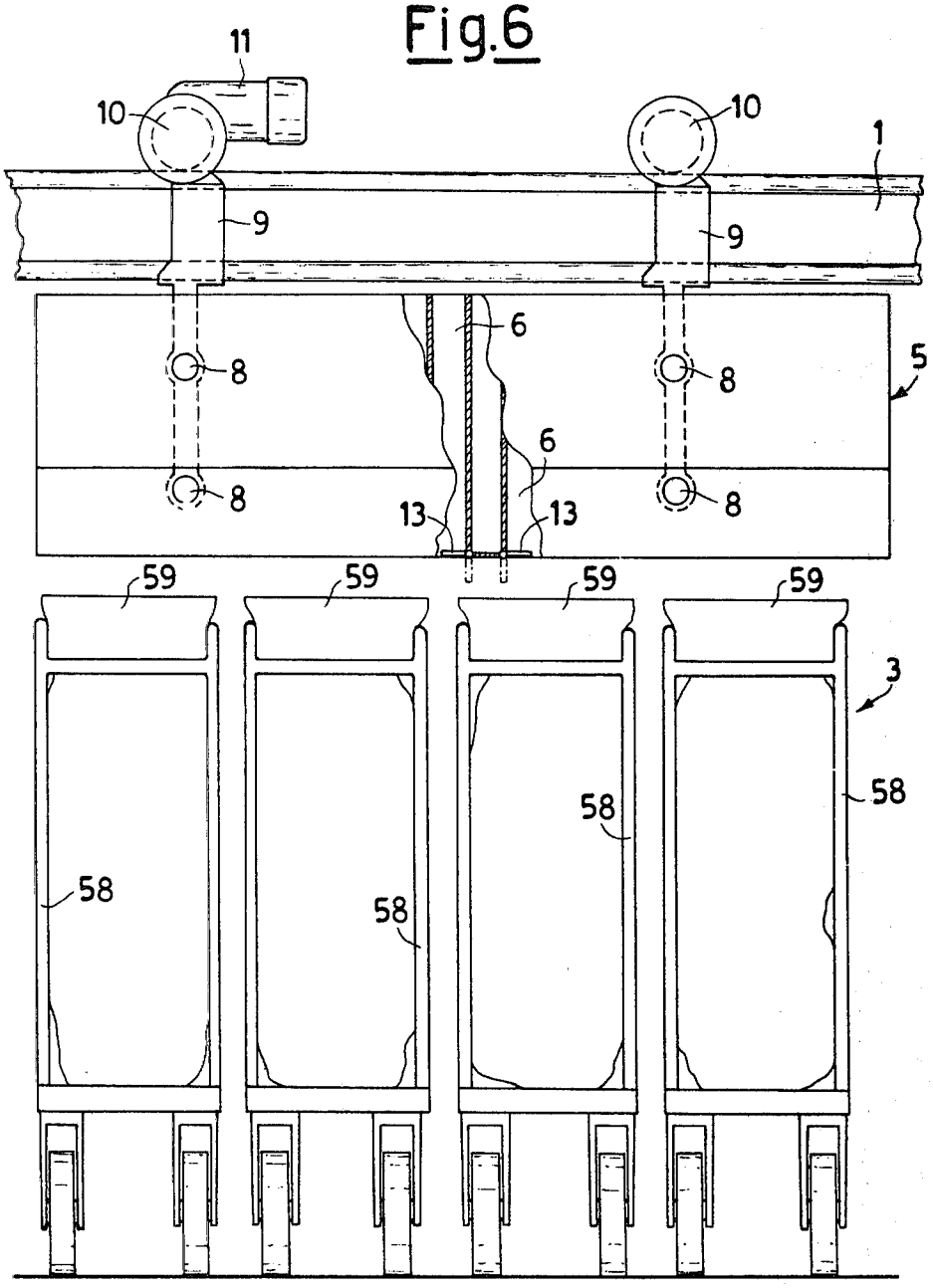
FIG. 6 is a diagrammatic side view of a group of containing compartments, rigidly connected together, at a sorting station in the machine.
Figure 7:
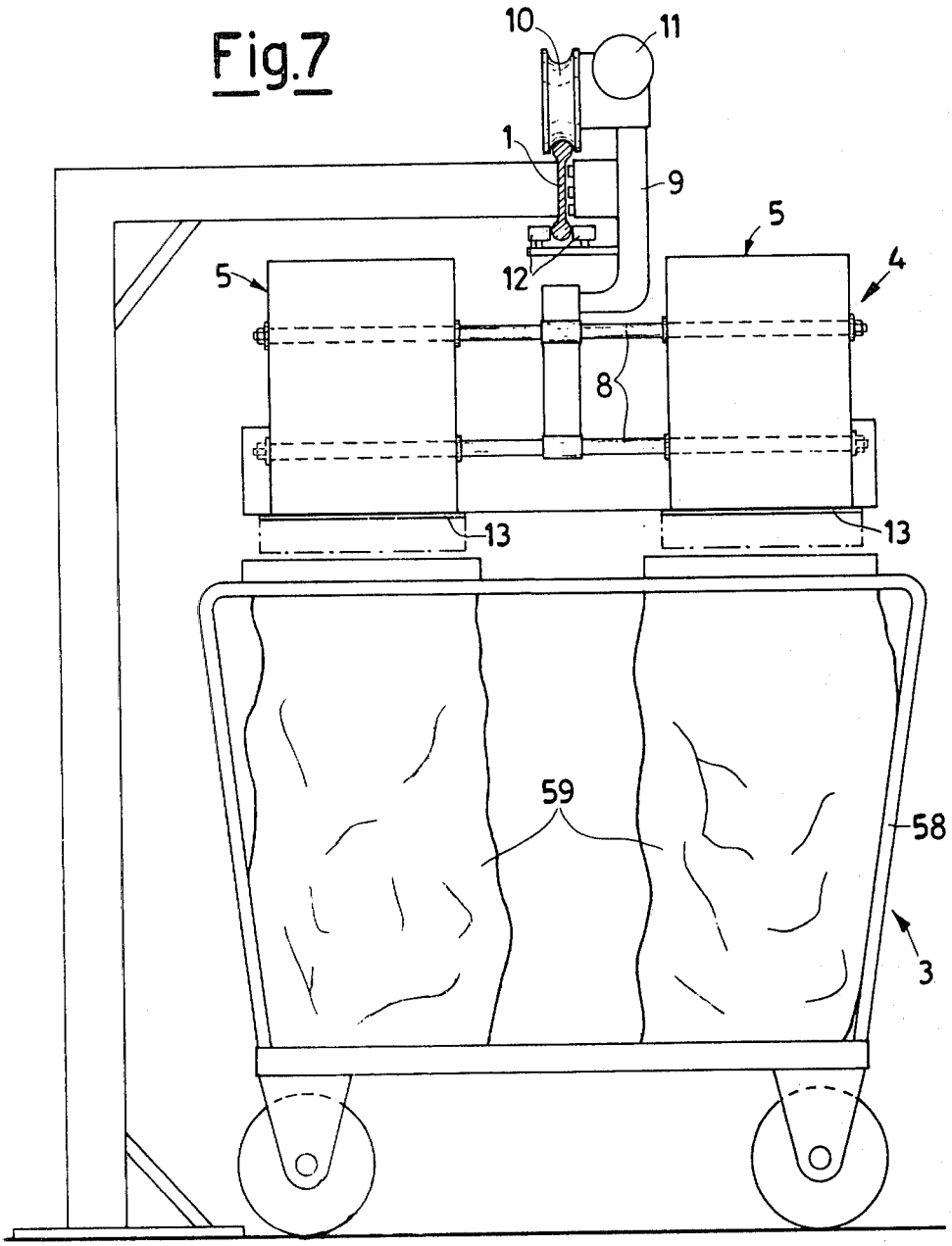
FIG. 7 is a view of the assembly of FIG. 6 seen from the right of said figure.

The carriages 4 with the various containing compartments 6 and 7 are thus loaded with one object per compartment, and are fed to one or other of the four sorting stations 3, each of which, as shown in FIGS. 1, 6 and 7, consists substantially of a succession of independent trolleys 58, each of which supports two bags 59, one for each of the two packs 5 of each carriage 4.

When a compartment 6 or 7 with its object to be sorted arrives above the bag 59 corresponding to the desired destination for said object, the control unit operates the relative actuator 18 or 28 in order to open the bottom of the compartment. The object can thus fall into the underlying bag 59.

The embodiment shown on the drawings and described heretofore is clearly only one of the many possible embodiments of the machine according to the invention. All its parts can in practice comprise numerous modifications, some of which are described by way of example hereinafter:

(a) The containing compartments 6 and 7 can be in the form of single containers individually connected to the conveying system, or can be grouped into multiple containers 5, each of which is connected to the conveying system. In both cases, either a single line or multiple lines of compartments can be used, as in the case shown on the drawings. The number of bags 59 associated with each trolley 58 in the sorting stations 3 obviously depends on the number of lines of compartments.

(b) The guide can be of the monorail type 1 as shown on the drawings, and support carriages with a self-contained drive motor as in the case of the carriages 4, or alternatively can consist of a monorail guiding a chain or cable for conveying the carriages, or alternatively can consist of a monorail for supporting and guiding carriages which can be connected to and released from a chain drive system as required, or again can consist of a floor guide for the carriages. The methods comprising a monorail with self-driven carriages or with connectable and releasable carriages have the merit of allowing different speeds for the carriages over different portions of the path, and in particular a reduced speed (for example 0.2 m/sec.) at the loading and sorting stations, and a higher speed (for example 0.6 m/sec.) along the connecting portions.

(c) Instead of two pairs of chutes of different widths, a single pair of chutes of variable width could be used, as could accompanying belts or grips. The chute system could also be common to two adjacent loading positions. Finally, loading could take place from the side (compartments open laterally) instead of from above.

(d) As an alternative to the actuators 18 and 28 rigid with the carriage, fixed actuators could be used in order to cause pawls to emerge for opening the compartments by mechanical interference with suitable triggers associated with each individual compartment. The various triggers and actuators could also be offset laterally in order to reduce the frequency with which the triggers pass by the relative actuators, and thus increase the time available for switching the actuators and reduce the accuracy with which the position of the compartments must be noted.

(e) Instead of being in the form of bags 59, the sorting exits could be in the form of stackers with mobile bases in which as the objects fall and become stacked, they cause the base to progressively lower until the stacker is completely filled.

I claim:

1. A machine for sorting objects of various destinations, particularly suitable for bulky postal correspondence, comprising a guide defining a path of varying configuration and passing through at least one loading station including at least one loading position which is fed in succession with the objects to be sorted, and at least one sorting station including at least one succession of collection containers for objects of different destination, and at least one succession of compartments for containing individual objects, said compartments being in packs of single units independently movable one in respect of the others along said guide in order to convey the objects from said loading station to said sorting station, said compartments being in the form of narrow pigeon holes having their surface of maximum size perpendicular to the direction of movement, said pigeon holes being provided with base walls which can be opened on command in order to discharge the objects into said collection containers, said loading station providing for means for conveying said objects to said compartments, said conveying means comprising coupling means which can be operated in order to momentarily connect said conveying means to said compartments.

2. A machine as claimed in claim 1, wherein said narrow compartments are periodically interspersed with compartments of greater width.

3. A machine as claimed in claim 1, wherein said compartments are open upperly for loading the objects.

4. A machine as claimed in claim 1, wherein said single movable units include packs of mutually rigid compartments.

5. A machine as claimed in claim 4, wherein said packs of compartments are assembled in pairs to form carriages comprising one pack of compartments on each side of said guide, said sorting station including two successions of collection containers disposed likewise on the two sides of said guide.

6. A machine as claimed in claim 1, wherein said conveying means includes at least one chute for conveying the objects towards said compartments.

7. A machine as claimed in claim 6, wherein said chute can be rotated from a substantially horizontal position for receiving an object to be loaded, to a substantially vertical position for discharging the object into the relative compartment.

8. A machine as claimed in claim 1, wherein said guide is constituted by a rail arranged to support and guide self-driven carriages.

9. A machine as claimed in claim 1, wherein said guide is constituted by a support and guide rail, in which the carriages can be connected to and separated from a chain drive system.

10. A machine as claimed in claim 1, wherein said guide is for carriages on the ground, its purpose being to provide a fixed physical datum, but not necessarily by means of a mechanical connection, in order to be able to control any transverse motion of the carriages to the necessary extent.

* * * * *